US007281821B2

(12) United States Patent
Martin et al.

(10) Patent No.: US 7,281,821 B2
(45) Date of Patent: Oct. 16, 2007

(54) BEACON LIGHT WITH AT LEAST ONE EMITTING DIODE AND A METHOD FOR RETROFITTING THE BEACON LIGHT ONTO AN EXISTING INCANDESCENT BEACON LIGHT

(75) Inventors: Robert L. Martin, Little Silver, NJ (US); Tim Ellis, Neptune, NJ (US); Douglas E. Woehler, Jackson, NJ (US); Chenhua You, Manasquan, NJ (US); Peter C. Wong, Freehold, NJ (US)

(73) Assignee: Dialight Corporation, Farmingdale, NJ (US)

( * ) Notice: Subject to any disclaimer, the term of this patent is extended or adjusted under 35 U.S.C. 154(b) by 654 days.

(21) Appl. No.: 10/283,153

(22) Filed: Oct. 30, 2002

(65) Prior Publication Data

US 2004/0085764 A1 May 6, 2004

(51) Int. Cl.
*F21V 5/00* (2006.01)

(52) U.S. Cl. ..... 362/246; 362/294; 362/545

(58) Field of Classification Search ..... 362/240, 362/294, 555, 800, 655, 335, 545, 377–378, 362/548–549, 246

See application file for complete search history.

(56) References Cited

U.S. PATENT DOCUMENTS

| | | | | |
|---|---|---|---|---|
| 5,963,126 | A * | 10/1999 | Karlin et al. | 340/321 |
| 6,366,214 | B1 * | 4/2002 | Mitchell et al. | 340/815.45 |
| 2002/0122309 | A1 * | 9/2002 | Abdelhafez et al. | 362/294 |
| 2004/0042208 | A1 * | 3/2004 | Wu | 362/245 |

* cited by examiner

*Primary Examiner*—Ali Alavi
(74) *Attorney, Agent, or Firm*—Oblon, Spivak, McClelland, Maier & Neustadt, P.C.

(57) ABSTRACT

A beacon light member including a housing configured to be attached to a base member of a beacon light, the base member of the beacon light configured to utilize an incandescent light source. A power supply contained in the housing is configured to electrically connect to a power point in the base member. At least one light emitting diode (LED) light source is contained in the housing. A beacon light including a first base member, a second member, and at least one incandescent light source can also be retrofit. Under the retrofitting method, the at least one incandescent light source is removed, the second member is removed, and the second member is replaced with a beacon light module including at least one light emitting diode (LED) light source.

15 Claims, 4 Drawing Sheets

BEACON LIGHT WITH AT LEAST ONE EMITTING DIODE AND A METHOD FOR RETROFITTING THE BEACON LIGHT ONTO AN EXISTING INCANDESCENT BEACON LIGHT

BACKGROUND OF THE INVENTION

1. Field of the Invention

The present invention is directed to a beacon light that includes at least one light emitting diode as a light source, and to a method of retrofitting the beacon light onto existing beacon lights with conventional incandescent light sources.

2. Discussion of the Background

Beacon lights are used as signal light indicators typically in environments such as on top of office buildings, on mountains, on hills, on towers, on cellular phone towers, etc. The most common form of beacon light currently used utilizes incandescent light sources, e.g., conventional incandescent light bulbs, as their light source. However, utilizing incandescent light bulbs as the light source in a beacon light has certain drawbacks.

First, incandescent light bulbs are relatively energy inefficient, i.e. they draw a relatively large amount of current for operation, and thereby have relatively high operating costs. Further, incandescent light bulbs have relatively short lifetimes and thus require replacement often. That may be particularly troublesome with respect to beacon lights as beacon lights are often positioned at hard to reach locations, for example on the top of a building, on the top of a cellular phone tower, on the top of a hill, etc.

SUMMARY OF THE INVENTION

The applicants of the present invention have recognized a need for improvements in beacon light design, particularly with respect to making beacon lights more energy efficient and in reducing their maintenance requirements.

Accordingly, one object of the present invention is to provide a novel beacon light with increased energy efficiency and decreased maintenance costs. To achieve that object the present invention sets forth a novel beacon light utilizing at least one light emitting diode (LED) as the light source. The LED light source is significantly more energy efficient and has a significantly longer lifetime than a conventional incandescent light bulb.

The Applicants of the present invention have also recognized that many beacon lights with conventional incandescent light sources are currently in use and that benefits would be achieved if parts of those conventional incandescent beacon lights could still be used.

To achieve that object, the present invention sets forth a novel method of retrofitting an existing conventional incandescent beacon light with only a new module including an LED light source. With such an operation, several parts of the existing beacon lamp housing can still be utilized and need not be replaced, and only a portion of the conventional beacon lamp need be replaced. Such an operation provides an easy and low cost retrofit with an improved light source.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
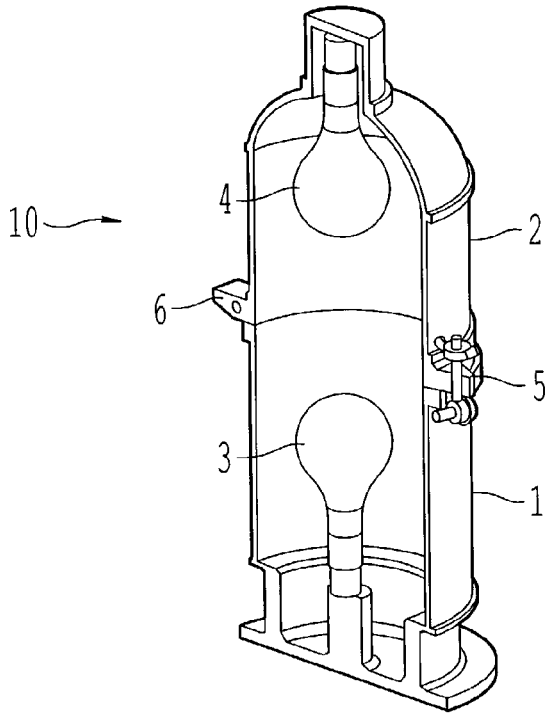
FIG. 1 shows a cut-away view of a conventional beacon light with incandescent light sources in a hinged position.
Figure 2:
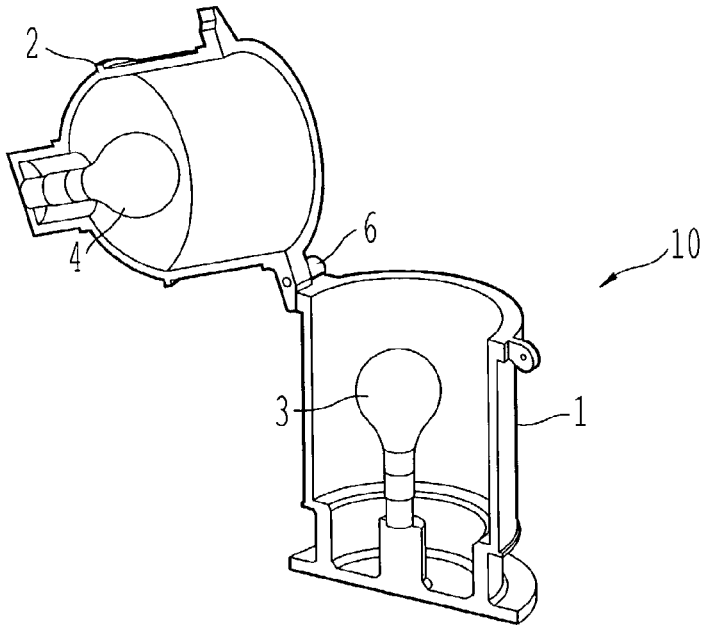
FIG. 2 shows a cut-away view of a conventional incandescent beacon light in an unhinged position.

Referring now to the figures, in which like reference numerals are used throughout the several views to represent identical or corresponding parts, FIGS. 1 and 2 show a conventional incandescent beacon light 10 in cut-away views. As shown in FIGS. 1 and 2, such an incandescent beacon light 10 includes a base housing 1 that houses a first incandescent light bulb 3 and a second housing 2 that houses a second incandescent light bulb 4. The second housing 2 is mounted above the base housing 1 by a hinge and locking structure 6, 5. To access internal portions of the incandescent beacon light 10 the locking member 5 is opened and the second housing 2 is separated from the base housing 1 at the hinge 6, as shown in FIG. 2. That provides access to the incandescent light bulbs 3, 4 when they burn out and need replacement.

Such a conventional incandescent beacon light 10 as shown in FIGS. 1 and 2 suffers from drawbacks in that the incandescent light bulbs 3, 4 are relatively energy inefficient and require replacement relatively often.

The present inventors have recognized that a beacon light utilizing light emitting diodes (LED) as a light source instead of utilizing conventional incandescent light bulbs 3 and 4 in the conventional beacon light 10 shown in FIGS. 1 and 2 would provide improvements in energy efficiency and reduction in maintenance operations.

However, the present inventors have also recognized that many conventional incandescent beacon lights 10 are already in use, and that complete replacement of such existing incandescent beacon lamps may be difficult, time consuming, and expensive. Further, in the instance of completely replacing an existing incandescent beacon light with a completely new beacon light, the existing incandescent beacon light's mounting hardware, for example various nuts, bolts, etc., will often have corroded and become "frozen", necessitating extreme and difficult removal techniques, which in turn results in a time consuming and aggravating operation.

Accordingly, the present invention provides a novel LED beacon light module that can be retrofit onto the base housing 1 of the existing conventional incandescent beacon light 10.

Figure 3:
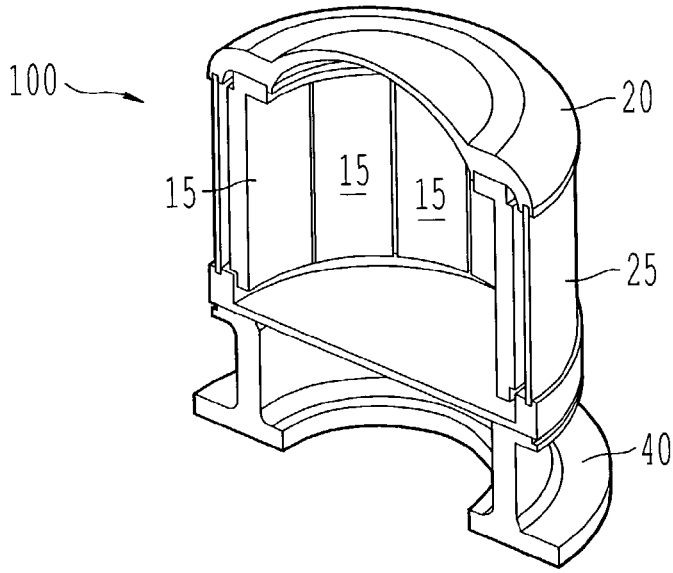
FIG. 3 shows a cut-away view of a novel LED beacon replacement module to be attached to a stand alone base unit according to the present invention.
Figure 4:
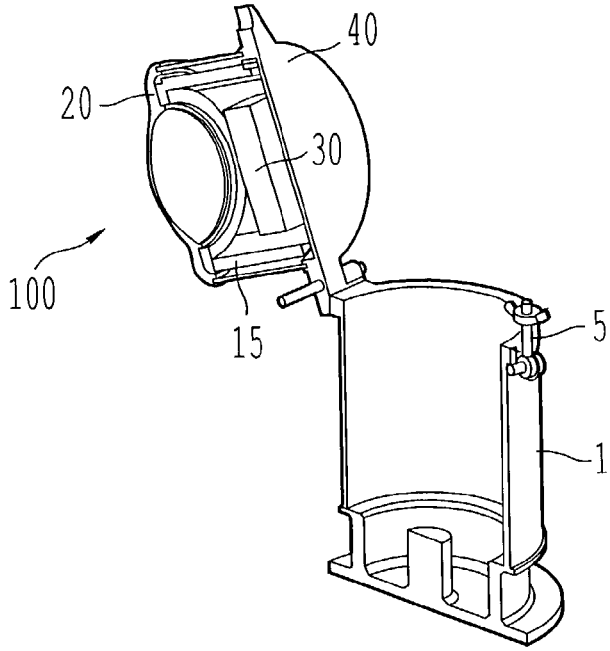
FIG. 4 shows a cut-away view of the novel LED beacon module of the present invention mounted on a conventional incandescent beacon light base in an unhinged position.
Figure 5:
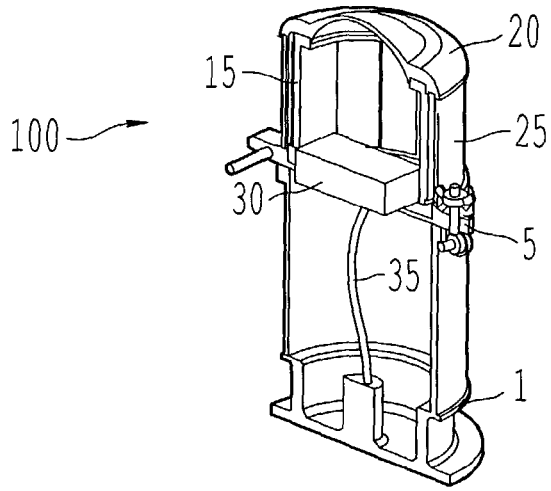
FIG. 5 shows a cut-away view of the novel LED beacon module of the present invention fully mounted on a conventional incandescent beacon light base.

With reference to FIGS. 3-5, one method of the present invention is to utilize the novel LED beacon module 100 as a replacement for only the second housing 2 of the existing incandescent beacon light 10. That is, if a conventional incandescent beacon light 10 as shown in FIGS. 1 and 2 is to be retrofit, an option provided by the present invention is to initially remove both of the incandescent light bulbs 3, 4 from each of the base housing 1 and second housing 2. Then, the second housing 2 is completely removed from the base housing 1. Further, a new LED module 100 as shown in FIG. 3 in the present specification is then retrofit to replace the second housing 2, as shown in FIGS. 4 and 5.

Figure 6A:
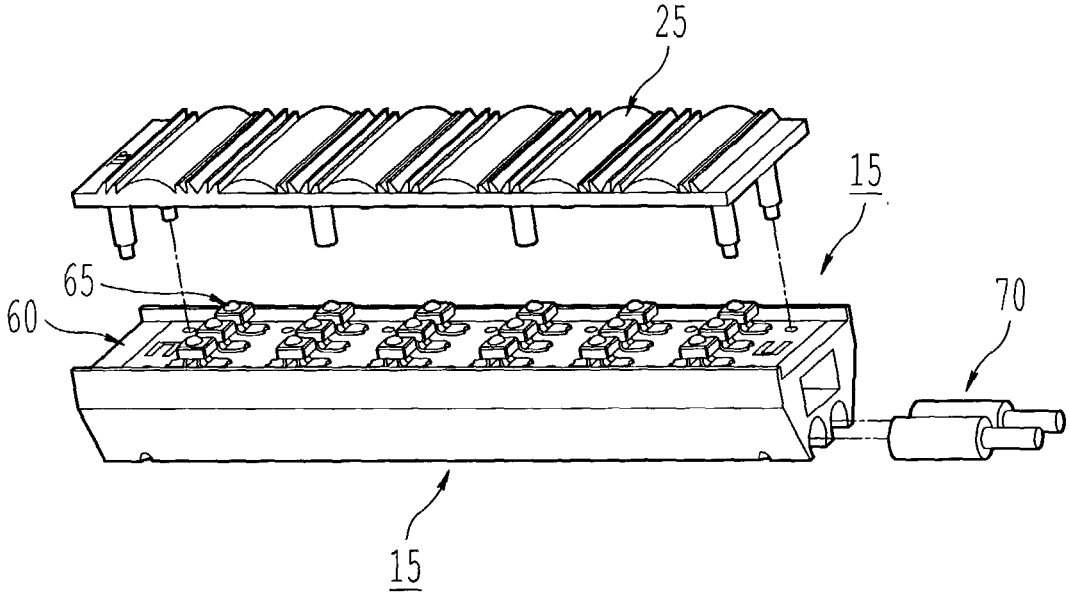
FIGS. 6A and 6B show a component of the novel LED beacon module according to the present invention.
Figure 6B:
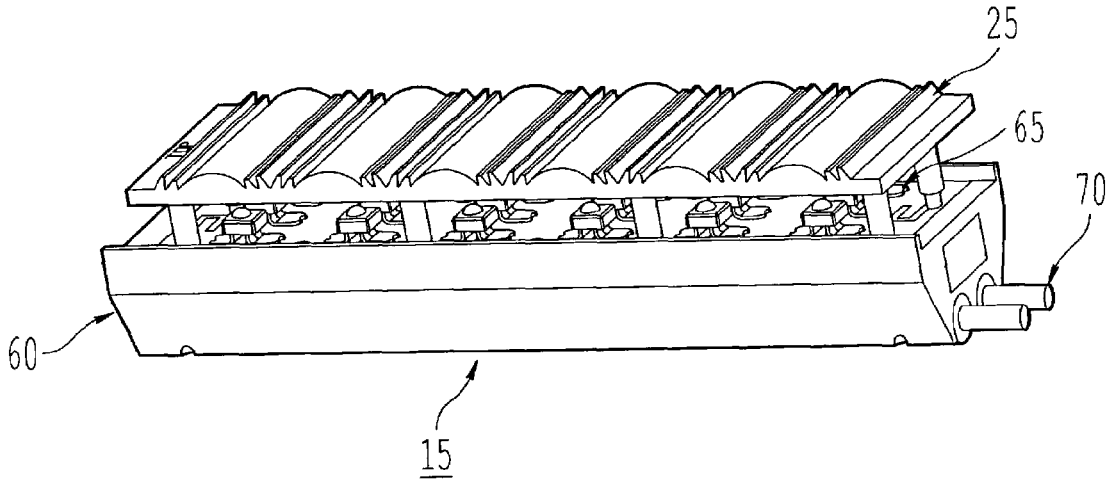

As shown in FIG. 3 the LED beacon module 100 of the present invention includes various LED modules 15 each including at least one LED element. Details of the LED modules 15 are shown in FIGS. 6(*a*), 6(*b*), discussed below. A window or lens 25 is provided at the outside of those LED modules 15 to allow the transmission of light out from the LED modules 15. The element 25 can be a simple window or a lens if a specific type of focusing is desired. A top cover 20, which can also be transparent to light, is provided at a top of the LED beacon module 100. Further, the LED beacon module 100 includes a bottom plate 40 that adapts to the base housing 1 of the conventional incandescent beacon light 10. That bottom plate 40 can take on many different configurations depending on the specifics of the structure of the base housing 1 of the conventional incandescent beacon light 10. As shown in FIGS. 4 and 5 the LED beacon module 100 also includes a power source 30 that can be connected by a power cable 35 to an electrical connection in the base housing 1 of the existing conventional incandescent beacon light 10, and particularly to a point within that base housing 1 that provided electrical power to the original incandescent light bulb 3.

The power supply 30 provides the operation of converting the power from the base housing 1 of the conventional incandescent beacon light 10 into a power suitable for the LED modules 15.

Details of the LED modules 15 as shown above are provided in FIGS. 6(*a*), 6(*b*). As shown in those FIGS. 6(*a*), 6(*b*), each LED module 15 includes an array of LED elements 65 mounted on a heat sink block 60. The heat sink block 60 provides heat sinking properties for the heat generated by the individual LED elements 65. Further, a window or lens 25 is mounted over the LED 65 to provide the appropriate focusing of light output from the LED elements 65. Further, an electrical power connector 70 is provided for electrical connection to the LED 65.

That electrical power connector 70 can provide a connection in the following manner. A printed circuit card with mating connectors or discrete wiring with mating connectors can be located at the top surface of the bottom plate 40 of the LED beacon module 100. Additionally, a mechanical location or indexing keys may be located on the top surface of the bottom plate 40. That mechanical location or indexing keys may serve to locate, orient, secure, and provide power to the LED modules 15. Additionally, the power supply may be provided with connectors that plug into mating connectors on the printed circuit card, or into discrete wiring with mating connectors.

The LED beacon module 100 can then be sealed to the base portion 1 using the same mounting element, i.e., a same geometry mounting flange, same gasket, etc., as employed in the original incandescent beacon light 10.

With such a structure in the present invention, an existing incandescent beacon light 10 as shown in FIGS. 1 and 2 can be retrofit to use a more energy efficient and a less maintenance requiring LED light source based beacon light module 100 in lieu of the conventional incandescent light bulbs 3,4. Further, the use of a LED beacon light module 100 including all necessary elements allows the retrofit to take place quickly and inexpensively.

Further, it is also possible to provide the beacon light module 100 shown in FIG. 3 as an original beacon light, i.e., not as merely a retrofit. In that instance, the beacon light module 100 could be mounted on a specially designed base housing or could be mounted on a base housing such as the existing base housing 1. That option provides a brand new entire beacon light 100 as shown in FIG. 3, rather than merely a retrofit module.

Obviously, numerous additional modifications and variations of the present invention are possible in light of the above teachings. It is therefore to be understood that within the scope of the appended claims the present invention may be practiced otherwise than as specifically described herein.

What is claimed is:

1. A method for retrofitting a beacon light including a first base housing member, a second member formed as a housing, and at least one incandescent light source provided in the first base housing member, the method comprising:

(a) removing the at least one incandescent light source;

(b) completely removing the second member formed as a housing; and (c) replacing the second member with a beacon light module formed as a housing including at least one light emitting diode (LED) light source, the beacon light module including a base plate adapted to the first base housing member such that the beacon light module fits on top of, without entering into, the first base housing member.

2. A method according to claim 1, wherein the at least one incandescent light source includes first and second incandescent light sources, the first light incandescent source provided in the first base member and the second incandescent light source provided in the second member, and the removing (a) removes both of the first and second incandescent light sources.

3. A method according to claim 2, wherein the beacon light module comprises:

(a) a housing configured to be attached to the first base member of the beacon light;

(b) a power supply contained in the housing and configured to be electrically connected to a power point in the base member; and (c) the least one LED light source contained in the housing.

4. A method according to element 3, wherein the at least one LED comprises plural LEDs provided in different individual LED modules.

5. A method according to claim 4, wherein the beacon light module further comprises:

(d) a window surrounding the at least one LED.

6. A method according to claim 4, wherein the beacon light module further comprises:

(d) a window surrounding the different individual LED modules.

7. A method according to claim 1, wherein the beacon light module comprises:

(a) a housing configured to be attached to the first base member of the beacon light;

(b) a power supply contained in the housing and configured to be electrically connected to a power point in the base member; and (c) the least one LED light source contained in the housing.

8. A method according to claim 7, wherein the at least one LED comprises plural LEDs provided in different individual LED modules.

9. A method according to claim 8, wherein the beacon light module further comprises:

(d) a window surrounding the different individual LED modules.

10. A method according to claim 7, wherein the beacon light module further comprises:

(d) a window surrounding the at least one LED.

11. A method for retrofitting a beacon light including a first base housing member, a second member formed as a housing, and at least one incandescent light source provided in the first base member, the method comprising:

(a) removing the at least one incandescent light source from the first base member;

(b) completely removing the second member formed as a housing; and (c) replacing the second member with a beacon light module as a housing including at least one light emitting diode (LED) light source, the LED light source connecting to a power point in the first base member through a wire connection, the beacon light module including a base plate adapted to the first base housing member such that the beacon light module fits on top of, without entering into, the first base housing member.

12. A method according to claim 11, wherein the at least one incandescent light source includes first and second incandescent light sources, the first light incandescent source provided in the first base member and the second incandescent light source provided in the second member, and the removing (a) removes both of the first and second incandescent light sources.

13. A method according to claim 11, wherein the at least one LED light source comprises plural LEDs provided in different individual LED modules.

14. A method according to claim 13, wherein the beacon light module comprises:

a window surrounding the different individual LED modules.

15. A method according to claim 11, wherein the beacon light module comprises:

a window surrounding the at least one LED.

* * * * *